United States Patent [19]

Brouse et al.

[11] 4,302,991

[45] Dec. 1, 1981

[54] FASTENER PLUNGING APPARATUS

[76] Inventors: S. Bernard Brouse, 14038 Terry Dr., Orland Park, Ill. 60462; John Wiedel, 9024 S. Oakley, Chicago, Ill. 60620

[21] Appl. No.: 125,607

[22] Filed: Feb. 28, 1980

[51] Int. Cl.[3] ..... B25B 23/00

[52] U.S. Cl. ..... 81/429; 81/57.37

[58] Field of Search ..... 81/57.37, 429

[56] References Cited

U.S. PATENT DOCUMENTS

| | | | |
|---|---|---|---|
| 2,565,505 | 8/1951 | Lamb . | |
| 2,796,161 | 6/1957 | Graybill | 81/429 |
| 2,943,652 | 7/1960 | Chilton . | |
| 3,869,942 | 3/1975 | DeCaro | 81/429 |
| 4,014,225 | 3/1977 | Lejdegard et al. . | |
| 4,030,383 | 6/1977 | Wagner | 81/429 |
| 4,058,884 | 11/1977 | Lydon et al. . | |
| 4,146,071 | 3/1979 | Mueller et al. . | |

FOREIGN PATENT DOCUMENTS

| | | | |
|---|---|---|---|
| 634052 | 1/1962 | Canada | 81/429 |

*Primary Examiner*—James L. Jones, Jr.

*Attorney, Agent, or Firm*—William F. Riesmeyer, III

[57] ABSTRACT

Apparatus is provided for plunging a fastener through a soft material preparatory to insertion of the fastener in a hard backing. The apparatus may be embodied as an attachment for a conventional fastener feed apparatus or as an improved form of feed apparatus itself. The improvement includes two telescoping members biased to a normal fully extended position. The members are engageable end-to-end with conventional telescoping elements of the feed apparatus and are axially movable with them. The force biasing the members apart is set so as to be substantially less than the force biasing the conventional elements to a fully extended position so that the fastener will be plunged through the soft material first upon application of a force, and then subsequently inserted into the backing upon application of additional force. Apparatus is provided for limiting the collapsed length of the members so as to control the depth of the plunge.

2 Claims, 4 Drawing Figures

FASTENER PLUNGING APPARATUS

BACKGROUND OF THE INVENTION

This invention relates to apparatus for driving fasteners, or more particularly to apparatus for plunging a fastener through a soft material prior to insertion of the fastener into a hard backing adjacent the soft material.

Various fastener feed apparatuses are available. Examples are shown in U.S. Pat. No. 4,146,071 Muller et al, U.S. Pat. No. 4,058,884.

Lydon et al, U.S. Pat. No. 4,014,225 Lejdegard et al, U.S. Pat. No. 2,943,652 Chilton and U.S. Pat. No. 2,565,505 Lamb. Generally these devices provide two telescoping elements which are collapsible when force is exerted thereon to insert the fastener into a material. Some devices include automatic feed magazines and have control for limiting the depth of insertion of the fastener. None of the available devices provide for insertion of a fastener through a soft material, e.g. foam insulation prior to contact with a hard backing material. Use of conventional devices to push the fastener through the foam often results in misalignment of the fastener with the driving element or backing material.

It is therefore a primary object of this invention to provide apparatus for plunging a fastener through a soft facing material prior to insertion and securing of the fastener in a hard backing.

SUMMARY OF THE INVENTION

According to this invention an attachment is provided for a fastener feed and/or drive apparatus which has conventional first and second telescoping elements with a passage axially through them for receipt of a driver element. The attachment includes first and second concentrically mounted elongated axially slidable members, the outer and inner ones of which have respectively inner and outer flanges for limiting extension of the members and preventing them from separating. The members also have an axial passage through them for receipt of the driver element axially so that the driver is both slidable and rotatable in the members. The members are engageable end-to-end with one of the telescoping elements of the feed apparatus so as to be moveable with such element. Means is provided for biasing the members to a normally fully extended position. The force exerted by this biasing means is substantially less than that exerted by a separate means similarly biasing the telescoping elements to an extended position. This causes the fastener to be plunged through the soft material when force is initially applied axially on the driver telescoping elements and members prior to application of additional force for securing the fastener into the hard backing material. A means is also provided to limit the depth of the plunge. Thus the driver is used to plunge the fastener through the soft material and is retained in proper alignment with the fastener while the fastener is aligned against a hard packing material prior to application of additional force necessary for its insertion therein.

In another form of the invention an improved fastener feed device is provided incorporating the apparatus of this invention.

DESCRIPTION OF THE PREFERRED EMBODIMENT

Figure 1:
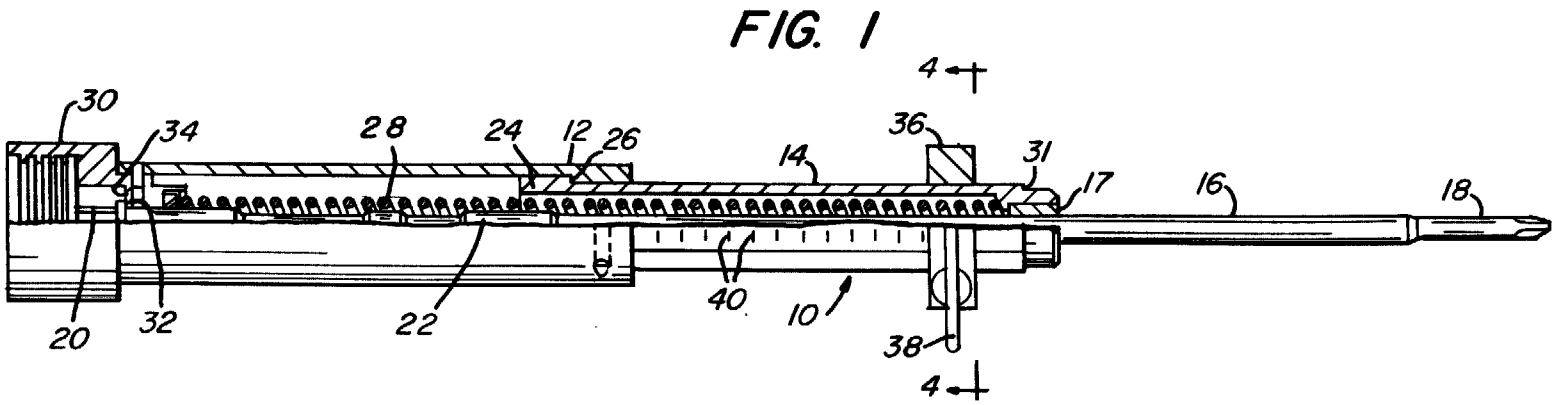
FIG. 1 is a side elevation view partially in cross section of the apparatus according to the invention.
Figure 4:
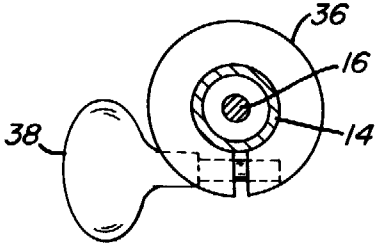
FIG. 4 is a section taken at 4—4 of FIG. 1.

Referring to FIG. 1 an attachment 10 is provided for use, for example in conjunction with a fastener feed apparatus of the type disclosed in U.S. Pat. No. 4,146,071 Mueller et al. The invention however, is useful with slight modification in conjunction with other feed or driver apparatuses. The attachment includes first and second members 12, 14 which are mounted concentrically and are axially slidable. The members have axial passages for receipt of a driver element 16 axially rotatable and slidably movable therein. Bushing 17 provides support for the driver. Driver 16 as shown includes a Phillips screw driver tip 18 and a head section 20 in this case attached to the tip by threaded connection 22. The members have respective flanges 24, 26 for limiting their extension and preventing them from separating. Spring 28 biases the members in the fully extended position as shown. Member 12 has adaptor 30 attached for engagement with conventional power driving and torque application means (not shown). Member 14 has a flange 31 for engagement with a telescoping element of a feed apparatus (not shown). Driver 16 has a flange 32 engageable with flange 34 of member 12 so that pressure exerted axially on the driver will collapse the members and plunge a fastener (not shown) into a foam material. Means is provided for limiting travel of member 12 in the form of an adjustable stop 36 attached to member 14 by hand tightened locking screw 38 (FIGS. 1 and 4). Indicia 40 (FIG. 1) are provided to indicate various desired depths of plunge.

Figure 2:
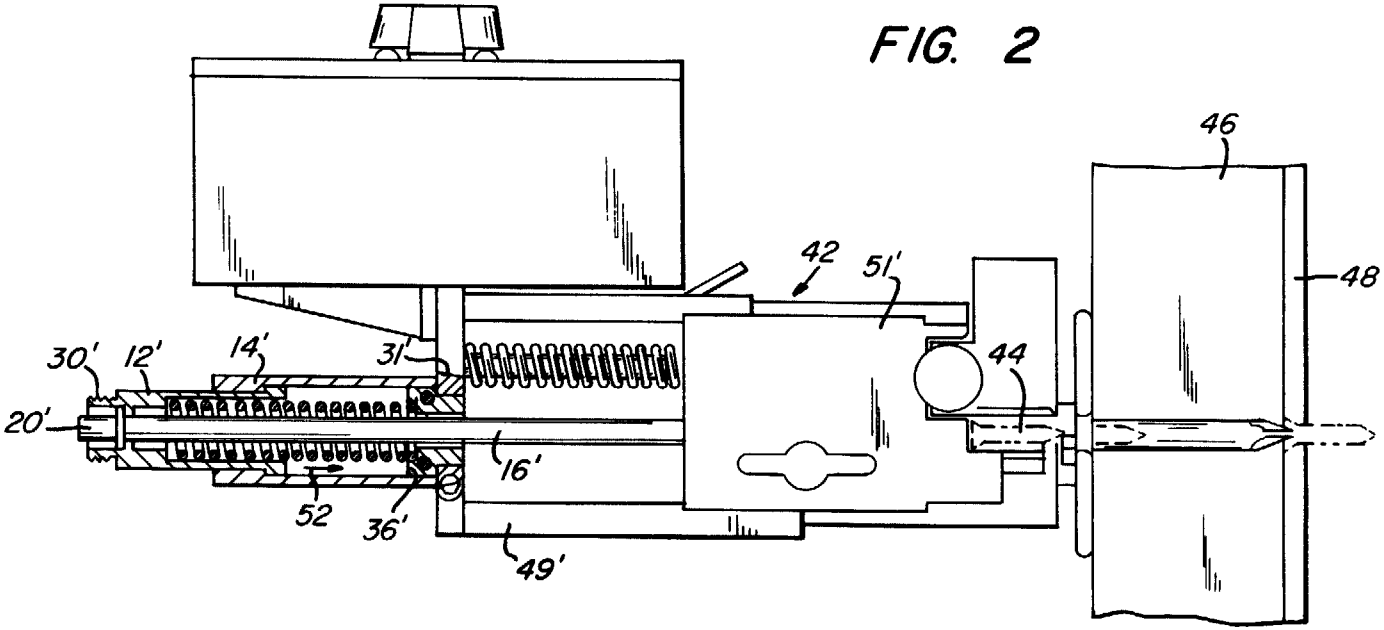
FIG. 2 is side elevation of a fastener feed apparatus incorporating a different embodiment of the inventive apparatus.

Referring to FIG. 2 a conventional feed apparatus 42 of the type shown in U.S. Pat. No. 4,146,071 is shown. A different embodiment of the apparatus of this invention is shown in combination with the feed magazine for plunging fastener 44 through foam material 46 preparatory to subsequent insertion in backing 48. Members 12', 14' as shown in FIG. 2 are reversed as to inner and outer concentric relationship. Also adaptor 30' as shown is an integral part of member 12'. Stop 36' is not adjustable in this embodiment. Flange 31' is shown engaging telescoping element 49' of the feed magazine.

Figure 3:
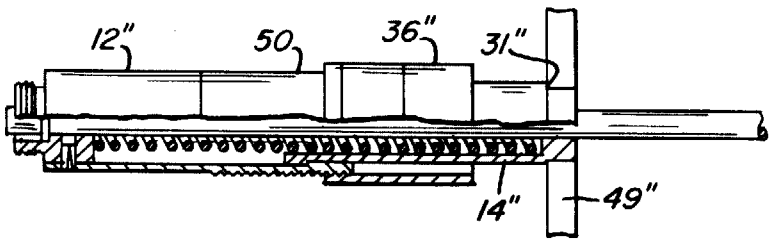
FIG. 3 is a side elevation of still another embodiment of the inventive apparatus for incorporation with fastener feed apparatus.

Finally, referring to FIG. 3 still another embodiment of the invention is shown for use in combination with the same fastener feed as in FIG. 2. In this embodiment a different form of stop 36'' is shown which is mounted on threaded portion 50 of member 12'' which in turn is concentrically mounted in member 14''. Again flange 31'' is shown engaged with telescoping element 49'' of the feed magazine.

Referring again to FIG. 2, the operation of the device is as follows: force exerted axially on head 20' of driver 16' collapses member 14', 14' by movement of member 12' in the direction 52 until it contacts stop 36'. The driver thus plunges fastener 44 into the foam material until its pointed end rests immediately adjacent backing material 48. At this stage, telescoping elements 49' and 51' of the feed magazine remain in their extended positions. Upon application of additional force on head 20' of driver 16' these members also collapse thus causing fastener 44 then to be inserted into the backing. Driver 12' may be axially rotated during this latter stage where screw fasteners are used as is the case with the apparatus shown.

We claim:

1. In a fastener drive apparatus, said apparatus having a set of first and second telescoping elements with a passage therethrough, a driver element for receipt in said passage and adapted on one end for engaging a fastener, and means for biasing said elements to a normally extended position the improvement in which said apparatus further comprises:

a second set of telescoping elements comprising first and second concentrically mounted elongated axially slidable members also having a passage therethrough for receipt of the driver element, said members of the second set of telescoping elements being connected end-to-end with the first set so as to be axially movable therewith, and separate means for biasing said members of the second set to a normal fully extended position, the force exerted by said separate biasing means being substantially less than the force exerted by the biasing means of said first set, so that a limited axial force exerted on said driver will collapse the first set, plunging the fastener through a soft facing material prior to application of additional force for inserting the fastener into a hard backing material, and means for limiting the collapsed length of the first set and thus the depth of plunge of the fastener.

2. The apparatus of claim 1 wherein said length limiting means is adjustable so that the depth of the plunge may be varied for various thicknesses of soft material.

* * * * *